US007871057B2

(12) United States Patent
Shimizu et al.

(10) Patent No.: US 7,871,057 B2
(45) Date of Patent: Jan. 18, 2011

(54) SENSOR ACTUATED FAUCET

(75) Inventors: Takeshi Shimizu, Fukuoka-ken (JP); Makoto Hatakeyama, Fukuoka-ken (JP); Masahiro Kuroishi, Fukuoka-ken (JP); Naoyuki Onodera, Fukuoka-ken (JP); Tomoko Sato, Fukuoka-ken (JP)

(73) Assignee: Toto Ltd., Fukuoka (JP)

( * ) Notice: Subject to any disclaimer, the term of this patent is extended or adjusted under 35 U.S.C. 154(b) by 557 days.

(21) Appl. No.: 11/999,004

(22) Filed: Dec. 3, 2007

(65) Prior Publication Data

US 2009/0272445 A1 Nov. 5, 2009

(30) Foreign Application Priority Data

Dec. 4, 2006 (JP) ..... 2006-326690
Dec. 3, 2007 (JP) ..... 2007-312916

(51) Int. Cl.
*F16K 31/02* (2006.01)

(52) U.S. Cl. ..... 251/129.04; 4/623

(58) Field of Classification Search ..... 251/129.01, 251/129.04, 118, 125; 4/623
See application file for complete search history.

(56) References Cited

U.S. PATENT DOCUMENTS 5,224,509 A * 7/1993 Tanaka et al. ..... 137/315.03
5,427,350 A * 6/1995 Rinkewich ..... 251/30.01
5,758,688 A * 6/1998 Hamanaka et al. ..... 137/624.11
5,918,855 A * 7/1999 Hamanaka et al. ..... 251/129.04
7,014,466 B2 * 3/2006 Cojic et al. ..... 434/105
7,406,722 B2 * 8/2008 Fukuizumi et al. ..... 4/623
7,445,024 B2 * 11/2008 Paterson et al. ..... 137/606
7,464,418 B2 * 12/2008 Seggio et al. ..... 4/623

FOREIGN PATENT DOCUMENTS

JP 2005-232831 9/2005

* cited by examiner

*Primary Examiner*—John K Fristoe, Jr.
(74) *Attorney, Agent, or Firm*—Carrier Blackman & Associates, P.C.; Joseph P. Carrier; William D. Blackman

(57) ABSTRACT

A faucet includes a main body and a water discharger having a water discharge port. The main body includes a first water supply channel placed therein and being communicative with a water supply piping; and a first electric component placed therein. The water discharger includes a second water supply channel placed therein, being communicative with the first water supply channel, and connected to the water discharge port; and a second electric component placed therein and being in electrical connection to the first electric component. The connection between the first electric component and the second electric component is made by wiring. The main body and the water discharger are detachable and capable of liquid-tight coupling to each other.

20 Claims, 14 Drawing Sheets

SENSOR ACTUATED FAUCET

CROSS-REFERENCE TO RELATED APPLICATIONS

This application is based upon and claims the benefit of priorities from the prior Japanese Patent Application Nos. 2006-326690, filed on Dec. 4, 2006 and 2007-312916, filed on Dec. 3, 2007; the entire contents of which are incorporated herein by reference.

BACKGROUND OF THE INVENTION

1. Field of the Invention

This invention relates to a faucet.

2. Background Art

An automatic faucet is conventionally known, which automatically discharges water from its tap when its sensor senses a hand stretched out below the tap. Also known is an apparatus which includes a small generator installed along the channel of the automatic faucet and stores electric power obtained in the generator for supplementing electric power for the above sensor and other circuits. For example, JP-A 2005-232831(Kokai) discloses an automatic faucet with its relatively large faucet body including a generator and the like.

SUMMARY OF THE INVENTION

According to an aspect of the invention, there is provided a faucet including: a main body; and a water discharger having a water discharge port, the main body including: a first water supply channel placed inside the main body and being communicative with a water supply piping; and a first electric component placed inside the main body, the water discharger including: a second water supply channel placed inside the water discharger, being communicative with the first water supply channel, and connected to the water discharge port; and a second electric component placed inside the water discharger and being in electrical connection to the first electric component, the connection between the first electric component and the second electric component being made by wiring, and the main body and the water discharger being detachable and capable of liquid-tight coupling to each other.

According to another aspect of the invention, there is provided a faucet including: a main body; and a water discharger having a water discharge port, the water discharger being detachable and capable of liquid-tight coupling to the main body, the main body including a first electric component placed therein, the water discharger including a second electric component placed therein and being in electrical connection to the first electric component, and the main body and the water discharger including a water supply piping being communicative with a water supply piping and the water discharge port.

DETAILED DESCRIPTION OF THE INVENTION

Figure 1:
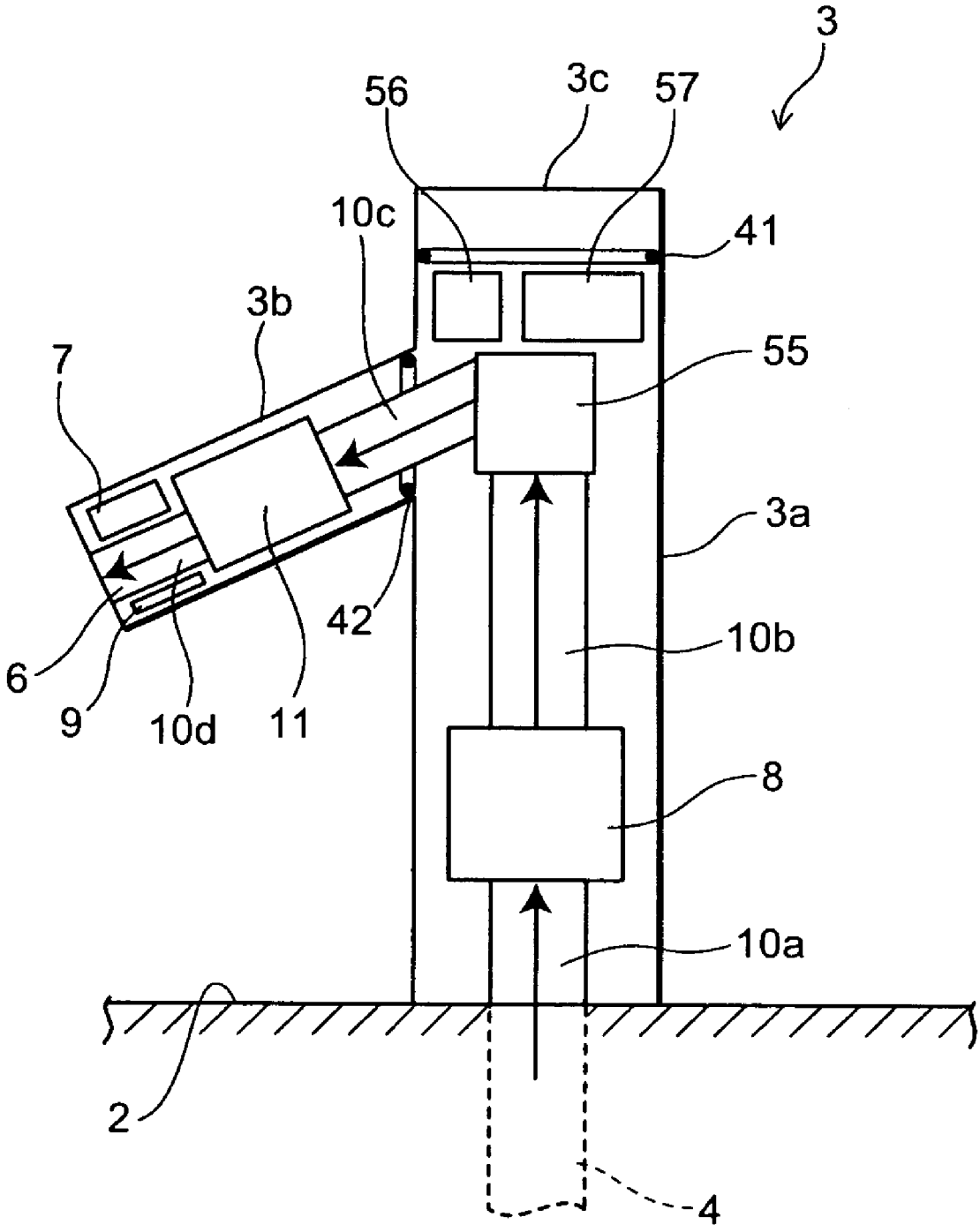
FIG. 1 is a schematic view showing the internal configuration of a faucet according to an embodiment of the invention.

An embodiment of the invention will now be described with reference to the drawings, where like elements in the drawings are marked with like reference numerals.

FIG. 1 is a schematic view showing the internal configuration of a faucet 3 according to the embodiment of the invention.

Figure 2:
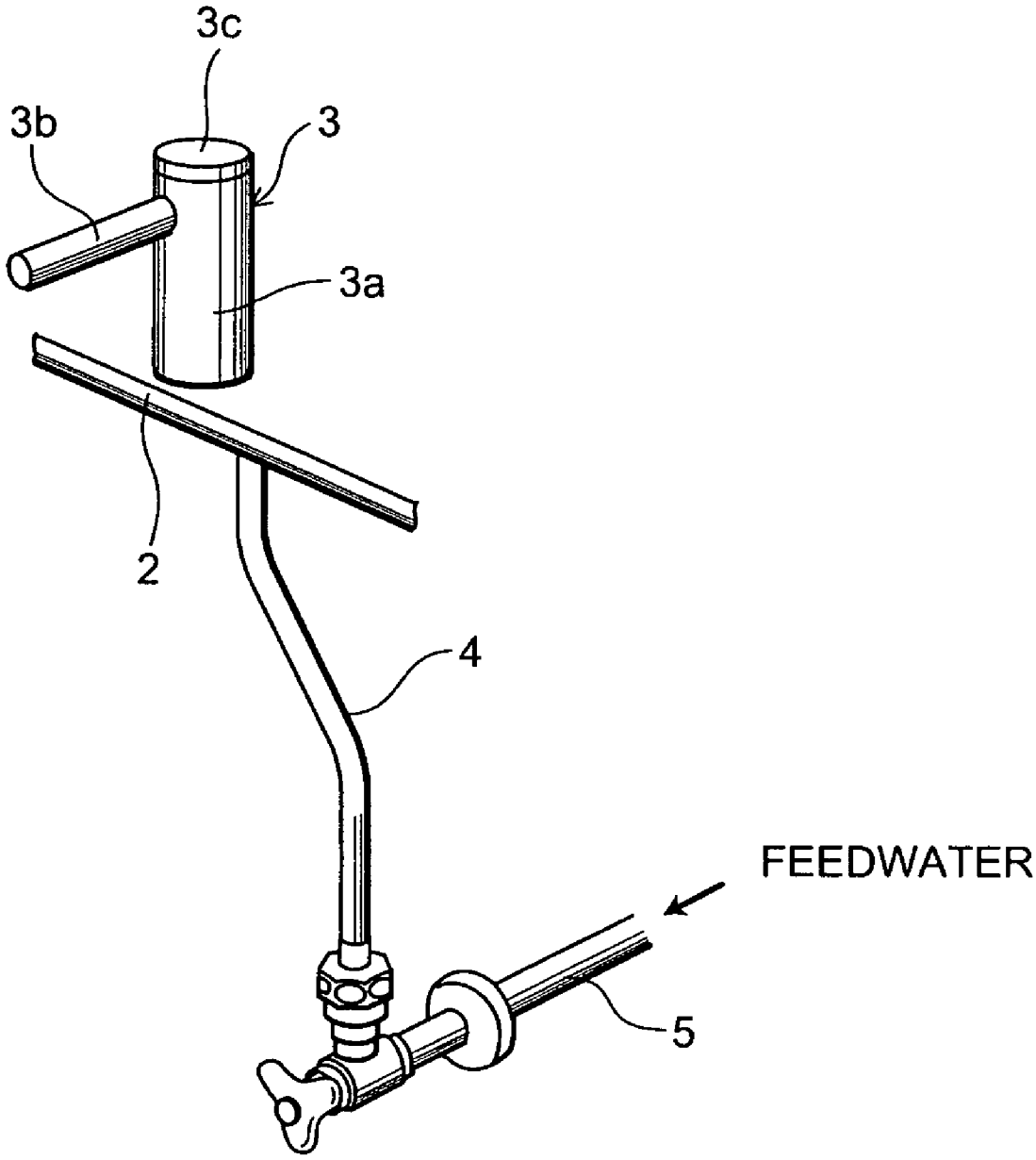
FIG. 2 is a schematic view showing the appearance and an installation example of the faucet.

FIG. 2 is a schematic view showing the appearance and an installation example of the faucet 3.

The faucet 3 according to this embodiment is illustratively installed on a washstand 2. The faucet 3 is connected to a water supply port 5 for tap water or the like through a water supply piping 4. The faucet 3 comprises a generally cylindrical main body 3*a*, a lid 3*c* provided on top of the main body 3*a*, and a water discharger 3*b* extending radially outward from the side face of the main body 3*a*.

An opening is formed at the top end of the main body 3*a* so that electric components to be placed inside the main body 3*a* can be loaded and unloaded through the opening. The lid 3*c* is coupled to the main body 3*a* so as to block the opening of the main body 3*a*. For example, the lid 3*c* is detachably screwed on the main body 3*a*. An O-ring 41 is illustratively interposed at the joint between the lid 3*c* and the main body 3*a* so that the lid 3*c* is liquid-tightly coupled to the main body 3*a*.

The water discharger 3*b* is detachably coupled to the main body 3*a*. An O-ring 42 is illustratively interposed at the joint between the water discharger 3*b* and the main body 3*a* so that the water discharger 3*b* is liquid-tightly coupled to the main body 3*a*.

Inside the main body 3*a* and the water discharger 3*b* are formed first and second water supply channels 10*a*-10*d* so that feedwater flowing from the water supply port 5 through the water supply piping 4 is guided to a water discharge port 6 formed at the tip of the water discharger 3*b*. The first water supply channels include water supply channels 10*a* and 10*b* located inside the main body 3*a*, and the second water supply channels include water supply channels 10*c* and 10*d* located inside the water discharger 3*b*.

Inside the main body 3*a*, a solenoid valve 8, a battery 56, and a controller 57 are placed as first electric components. The solenoid valve 8 opens and closes the first water supply channel 10*a*. A constant flow valve 55 for maintaining a constant amount of discharge is placed downstream of the solenoid valve 8. On the other hand, upstream of the solenoid valve 8 is placed a pressure reducing valve or a pressure regulating valve (not shown) for reducing pressure when the water supply pressure is too higher than the working pressure. It is noted that the constant flow valve 55 and the pressure reducing/regulating valve are provided appropriately as needed.

Inside the water discharger 3*b*, a faucet generator (hereinafter also simply referred to as generator) 11, a human body detection sensor 7, and an illuminator 9 are placed as second electric components. The generator 11 is placed inside the water discharger 3*b* downstream of the constant flow valve 55. Because the generator 11 is disposed downstream of the solenoid valve 8 and the constant flow valve 55, the water supply pressure (primary pressure) does not directly act on the generator 11. Hence the generator 11 does not require very high pressure tightness, being advantageous in terms of reliability and cost. The water discharge port 6 is formed at the tip of the water discharger 3*b*, and the sensor 7 is placed near the water discharge port 6. The sensor 7 can sense a user's hand or the like stretched out ahead of the water discharge port 6. The illuminator 9 illuminates the area ahead of the water discharge port 6. Placement of the illuminator 9 near the water discharge port 6 serves to achieve a guidance effect toward the water discharge port 6 and a presentation effect around the water discharge port 6.

The electric power generated in the generator 11 is stored in the battery 56. The controller 57 controls the driving of the sensor 7 and the opening/closing of the solenoid valve 8. The battery 56 and the controller 57 are placed near the top opening of the main body 3*a* and above the first and second water supply channels 10*a*-10*d*.

In the faucet 3 and the generator 11 configured as described above, when a user places their hand below the water discharge port 6, the sensor 7 senses it, and the controller 57 opens the solenoid valve 8. Thus the faucet generator 11 is supplied with running water. Its hydraulic power causes the generator 11 to generate electric power, and the water that has passed through the generator 11 is discharged from the water discharge port 6. When the user moves their hand away from below the water discharge port 6, the solenoid valve 8 is closed, and the water automatically stops. The generated electric power is stored in the battery 56, and then used for driving the solenoid valve 8, the sensor 7, the illuminator 9, and the controller 57, for example.

Recently, there has been a demand for a small and simple design for the faucet 3 with the generator 11 placed therein. However, if the design and downsizing are given higher priority, the internal space of the faucet 3 is restricted. Hence electric components such as the generator 11 and the controller 57 need to be efficiently placed inside the faucet 3. In the case of the faucet 3 having the main body 3*a* and the water discharger 3*b*, electric components need to be placed also inside the water discharger 3*b*. Furthermore, in view of installation and maintenance of the electric components, the main body 3*a* and the water discharger 3*b* need to be detachable.

According to this embodiment, electric components (generator 11) are placed also inside the water discharger 3*b* so that the internal space of the faucet 3 as a whole can be effectively used. Thus electric components can be efficiently housed in the faucet 3 even if the internal space of the main body 3*a* is narrowed by downsizing and design. Furthermore, the faucet 3 is configured as a combination of the main body 3*a*, the water discharger 3*b*, and the lid 3*c*, which are detachable. Thus installation, maintenance, and replacement of the electric components placed inside can be easily performed even if the internal space is narrowed by downsizing and design.

If the number of uses the automatic faucet per day exceeds a certain value, hydroelectric generation by the generator 11 can sufficiently cover the operation without using the backup battery 56, and the battery 56 will not be exhausted. Actually, however, the battery needs replacing because its maximum lifetime is approximately ten years, for example, as determined by its leakproof guarantee period and other factors. According to this embodiment, by removing the lid 3*c*, the top opening of the main body 3*a* is exposed outside, and the battery 56 placed near the top opening can be easily replaced. It is understood that replacement and maintenance of the controller 57 and other components can be also easily performed.

If the generator 11 is installed inside the water discharger 3*b* before the water discharger 3*b* is coupled to the main body 3*a*, the work can be done easily. At the time of maintenance or replacement of the generator 11, the generator 11 can be easily taken out of the water discharger 3*b* by detaching the water discharger 3*b* from the main body 3*a*. The water discharger 3*b* may be coupled to the main body 3*a* after the generator 11 is coupled to the second water supply channel 10*c*.

The second electric components placed inside the water discharger 3*b* need to be electrically connected by wiring to the first electric components placed inside the main body 3*a*. If the water discharger 3*b* is screw-coupled to the main body 3*a*, relative rotation therebetween causes a problem of twisting the above wiring. Furthermore, unless the water discharger 3*b* is liquid-tightly coupled to the main body 3*a*, water may intrude into the faucet 3 from outside, and the internal electric components may be soaked therewith.

In this embodiment, sealing members such as O-rings 41, 42 are interposed at the joint between the lid 3*c* and the main body 3*a* and at the joint between the water discharger 3*b* and the main body 3*a*. This can prevent water from intruding into the faucet 3 from outside, and prevent the controller 57, the battery 56, and the coil of the generator 11 from being soaked with water, achieving high reliability and durability.

The second electric components (generator 11, sensor 7, and illuminator 9) placed inside the water discharger 3*b* are electrically connected by wiring to the first electric components (controller 57 and battery 56) placed inside the main body 3*a*. Hence, in a configuration where the water discharger 3*b* is screwed on the main body 3*a*, the water discharger 3*b* needs to be rotated relative to the main body 3*a* when the water discharger 3*b* is attached to or detached from the main body 3*a*. As described above, this results in twisting the wiring connecting the second electric components to the first electric components, causing concern about disconnection and damage to the wiring.

In this embodiment, the water discharger 3*b* is coupled to the main body 3*a* by fitting, for example. Hence the water discharger 3*b* can be attached to or detached from the main body 3*a* without rotation, and no twist due to the rotation occurs in the wiring, ensuring high reliability.

The detachable structure of the water discharger 3*b* and the main body 3*a* is not limited to fitting, but they may be coupled by screw pressing force, or by clamping force of a nut or a cap nut.

Furthermore, the controller 57 is disposed above the first and second water supply channels 10*a*-10*d*. Hence, even if water droplets condensed on the outer surface of the channel pipe constituting the first and second water supply channels 10*a*-10*d* fall down or flow down along the channel pipe, the controller 57 can be prevented from being soaked therewith, and from suffering a breakdown. Likewise, because the battery 56 is also disposed above the first and second water supply channels 10*a*-10*d*, the battery 56 can be prevented from being soaked therewith, and from suffering a breakdown.

The wiring connecting the second electric components (generator 11, sensor 7, and illuminator 9) placed inside the water discharger 3*b* to the first electric components (controller 57 and battery 56) placed inside the main body 3*a* is disposed above the second water supply channel 10*c*. Hence, even if water droplets condensed on the outer surface of the second water supply channel 10*c* fall down or flow down along the channel pipe, the wiring can be prevented from being soaked therewith.

The faucet of the invention can be illustratively used as a kitchen faucet, a living and dining faucet, a shower faucet, a toilet faucet, and a lavatory faucet. The invention is not limited to the automatic faucet using a human body detection sensor, but is also applicable to a one-touch faucet which is manually switched on/off, a metering faucet which meters the flow and automatically stops discharging water, and a timed faucet which stops discharging water after a preset period of time has elapsed. The generated electric power may be used for illumination, generation of electrolyzed functional water such as alkali ion water and silver ion-containing water, flow rate display (metering), temperature display, and voice guidance.

In the faucet according to this embodiment, the discharge flow rate is illustratively set to 100 liters per minute or less, and preferably to 30 liters per minute or less. In particular, in the lavatory faucet, it is preferably set to 5 liters per minute or less. In the case of relatively high discharge flow rate such as in the toilet faucet, it is preferable that the water flow to the generator 11 be branched from the water supply pipe to regulate the flow rate through the generator 11 to 30 liters per minute or less. This is because, if the water flow from the water supply pipe is entirely passed through the generator 11, the number of revolutions of the rotor in the generator 11 increases, causing concern about the possibility of increasing noise and shaft wear. Furthermore, above an appropriate number of revolutions, the amount of power generation does not increase despite the increase of the number of revolutions, because of energy loss due to eddy current and coil heating.

In the following, examples of the coupling structure of the main body 3*a* and the water discharger 3*b* are described with reference to the drawings.

Figure 3A:
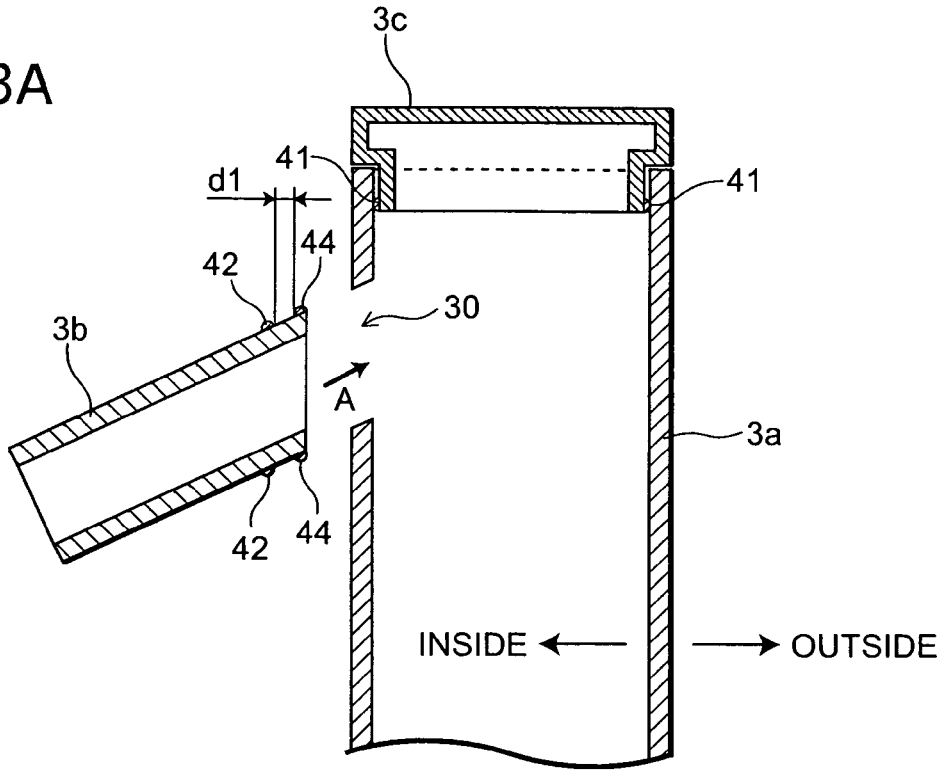
FIGS. 3A and 3B are cross-sectional schematic views illustrating an example of the coupling structure of the main body and the water discharger.
Figure 3B:
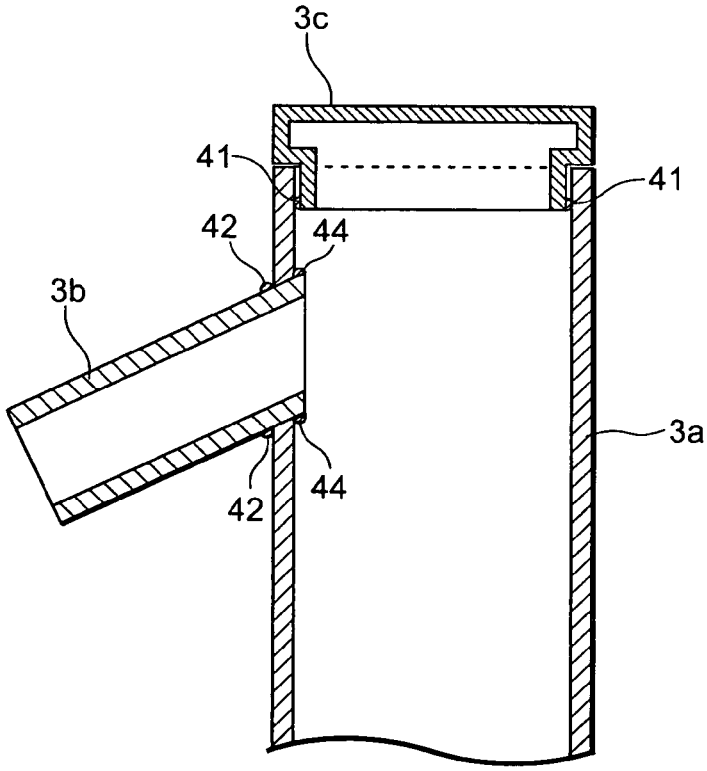

FIG. 3 shows cross-sectional schematic views illustrating an example of the coupling structure of the main body and the water discharger, where FIG. 3A is a cross-sectional schematic view before coupling the water discharger to the main body, and FIG. 3B is a cross-sectional schematic view after coupling the water discharger to the main body.

For convenience of description, the solenoid valve 8, the constant flow valve 55, the generator 11 and the like disposed inside the main body 3*a* and the water discharger 3*b* are not shown.

The water discharger 3*b* of this example has an O-ring 42 and a flexible protrusion 44 at the joint with the main body 3*a*. As shown in FIG. 3, the flexible protrusion 44 is disposed nearer to the tip of the water discharger 3*b* than the O-ring 42. The horizontal minimum distance d1 between the flexible protrusion 44 and the O-ring 42 is generally equal to or shorter than the thickness of the shell of the main body 3*a*. The O-ring 42 and the flexible protrusion 44 are illustratively made of resins or elastic bodies.

When the water discharger 3*b* is inserted into the opening 30 of the main body 3*a* in the direction of the arrow A, the flexible protrusion 44 is first inserted into the opening 30 of the main body 3*a*. At this time, because of the flexibility of the flexible protrusion 44, the water discharger 3*b* moves in the direction of the arrow A with the flexible protrusion 44 being shrunk. By continuing to further insert the water discharger 3*b*, the flexible protrusion 44 enters inside the main body 3*a*.

Because the minimum distance d1 is generally equal to or narrower than the thickness of the shell of the main body 3*a*, the shell of the main body 3*a* is pinched between the flexible protrusion 44 and the O-ring 42, as shown in FIG. 3B, when the flexible protrusion 44 enters inside the main body 3*a*. That is, the water discharger 3*b* is fitted into the main body 3*a*. Thus the water discharger 3*b* is fixed (coupled) to the main body 3*a*.

Here, the inner diameter of the opening 30 of the main body 3*a* is generally equal to the outer diameter of the water discharger 3*b*, which is fixed with the flexible protrusion 44 and the O-ring 42 made of resins or elastic bodies. Hence the water discharger 3*b* is liquid-tightly coupled to the main body 3*a*. On the other hand, it is possible to detach the water discharger 3*b* from the main body 3*a* by moving the water discharger 3*b* in the direction opposite to the arrow A.

Figure 4A:
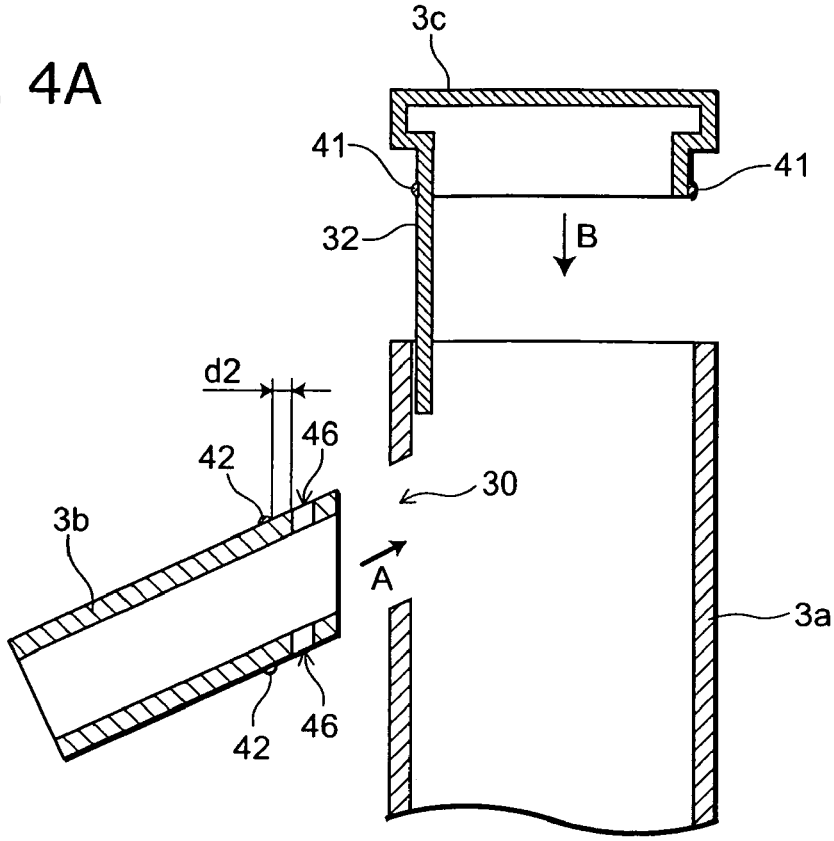
FIGS. 4A and 4B are cross-sectional schematic views illustrating another example of the coupling structure of the main body and the water discharger.
Figure 4B:
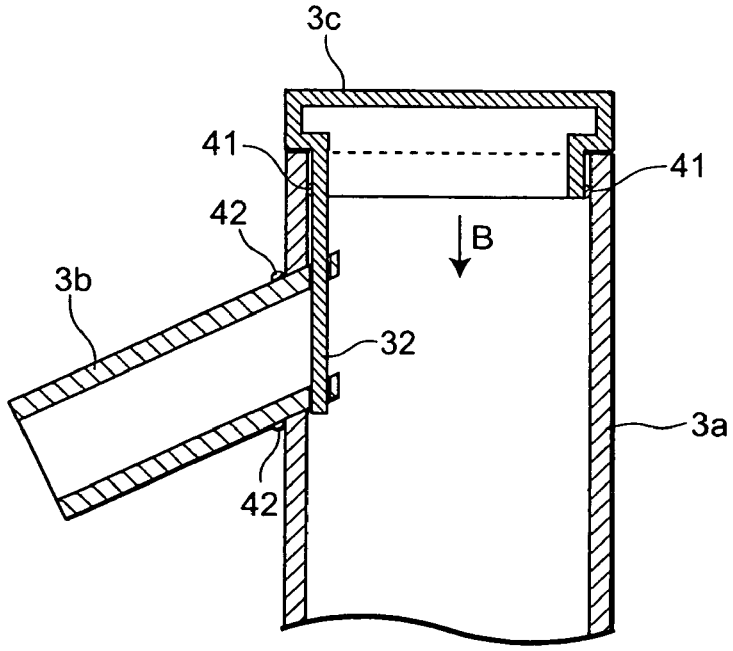

FIG. 4 shows cross-sectional schematic views illustrating another example of the coupling structure of the main body and the water discharger, where FIG. 4A is a cross-sectional schematic view before coupling the water discharger to the main body, and FIG. 4B is a cross-sectional schematic view after coupling the water discharger to the main body.

Like FIG. 3, for convenience of description, the solenoid valve 8, the constant flow valve 55, the generator 11 and the like disposed inside the main body 3*a* and the water discharger 3*b* are not shown.

The water discharger 3*b* of this example has an O-ring 42 and a through hole 46 at the joint with the main body 3*a*. As shown in FIG. 4, the through hole 46 is disposed nearer to the tip of the water discharger 3*b* than the O-ring 42. The horizontal minimum distance d2 between the through hole 46 and the O-ring 42 is generally equal to or shorter than the thickness of the shell of the main body 3*a*. On the other hand, the lid 3*c* has a protrusion 32. The outer diameter of the protrusion 32 is generally equal to or smaller than the inner diameter of the through hole 46.

When the water discharger 3*b* is inserted into the opening 30 of the main body 3*a* in the direction of the arrow A, the O-ring 42 is brought into contact with the outer periphery of the main body 3*a*. Subsequently, the lid 3*c* is inserted into the main body 3*a*. At this time, because the minimum distance d2 is generally equal to or shorter than the thickness of the shell of the main body 3*a*, the through hole 46 is not entirely located inside the main body 3*a*. Hence, in this state, the protrusion 32 cannot be inserted into the through hole 46. Then, when the water discharger 3*b* is further inserted along the. arrow A, the O-ring 42 is slightly shrunk, allowing the through hole 46 to entirely enter inside the main body 3*a*. At this time, the protrusion 32 provided on the lid 3*c* can be inserted into the through hole 46.

When the protrusion 32 is inserted into the through hole 46, the water discharger 3*b* is pushed by a repulsion force from the O-ring 42 in the direction opposite to the arrow A, but does not come off the opening 30 because the protrusion 32 is inserted into the through hole 46. That is, the O-ring 42 is generally pressed into the opening 30, and the water discharger 3*b* is locked into the main body 3*a* with the protrusion 32. Thus the water discharger 3*b* is fixed (coupled) to the main body 3*a*.

Here, the inner diameter of the opening 30 of the main body 3*a* is generally equal to the outer diameter of the water discharger 3*b*, and the O-ring 42 is generally pressed into the opening 30. Hence the water discharger 3*b* is liquid-tightly coupled to the main body 3*a*. On the other hand, it is possible to detach the water discharger 3*b* from the main body 3*a* by moving upward the lid 3*c* to pull out the protrusion 32 from the through hole 46 while moving the water discharger 3*b* in the direction of the arrow A.

Figure 5A:
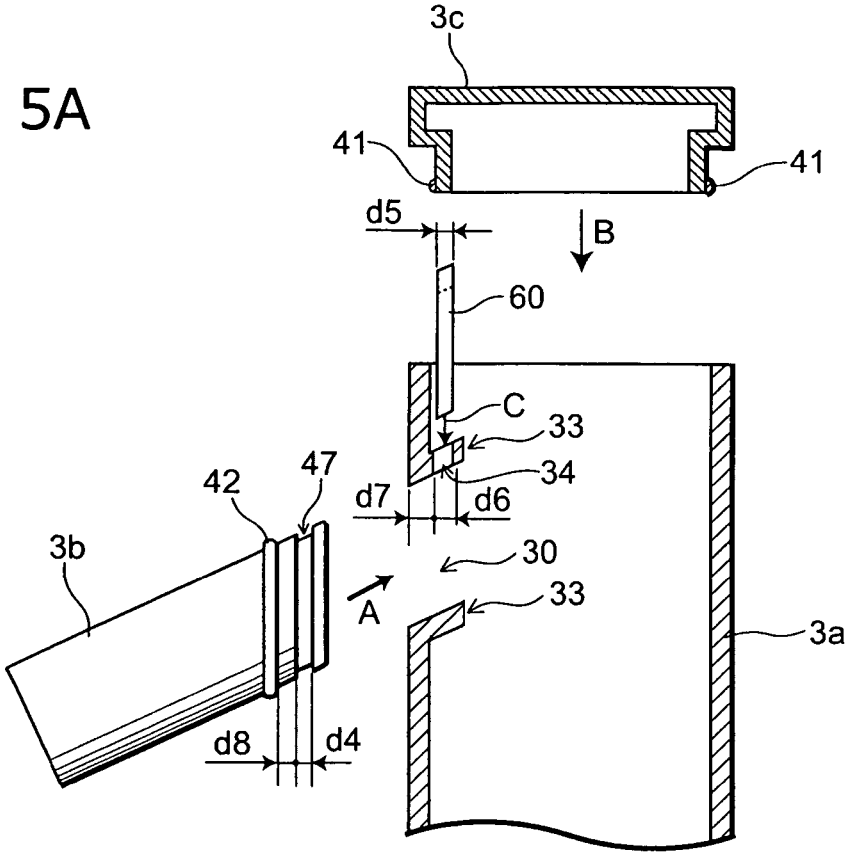
FIGS. 5A and 5B are cross-sectional schematic views illustrating still another example of the coupling structure of the main body and the water discharger.
Figure 5B:
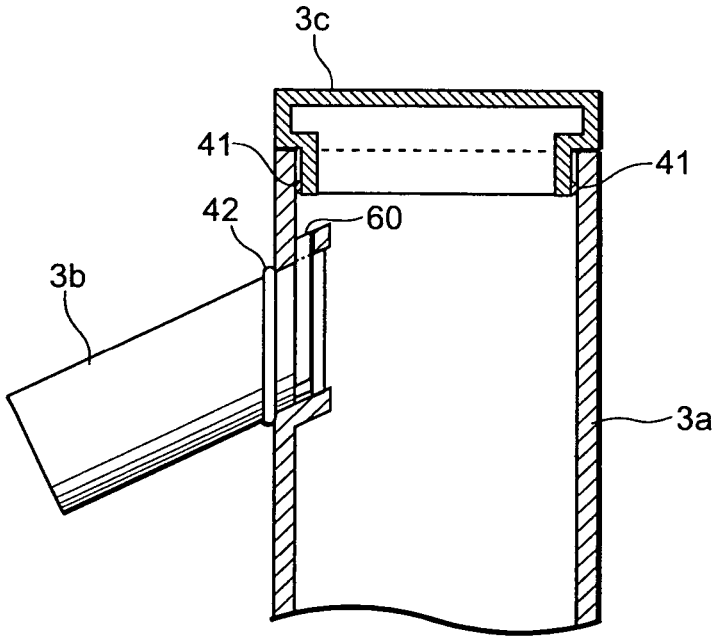

FIG. 5 shows cross-sectional schematic views illustrating still another example of the coupling structure of the main body and the water discharger, where FIG. 5A is a cross-sectional schematic view before coupling the water discharger to the main body, and FIG. 5B is a cross-sectional schematic view after coupling the water discharger to the main body.

Figure 6:
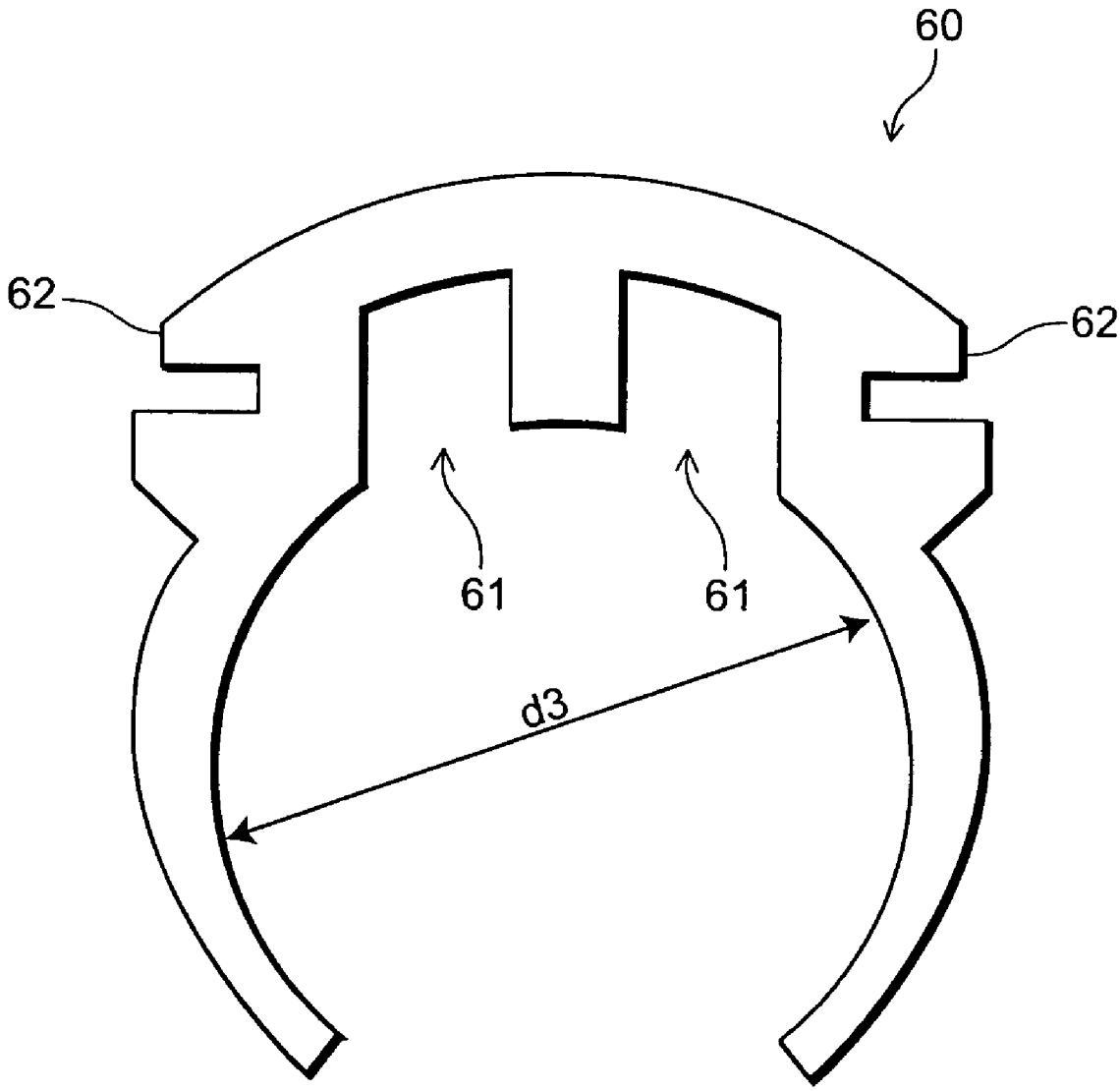
FIG. 6 is a schematic view illustrating a C-ring for fixing (coupling) the water discharger to the main body.

FIG. 6 is a schematic view illustrating a C-ring for fixing (coupling) the water discharger to the main body.

Figure 7A:
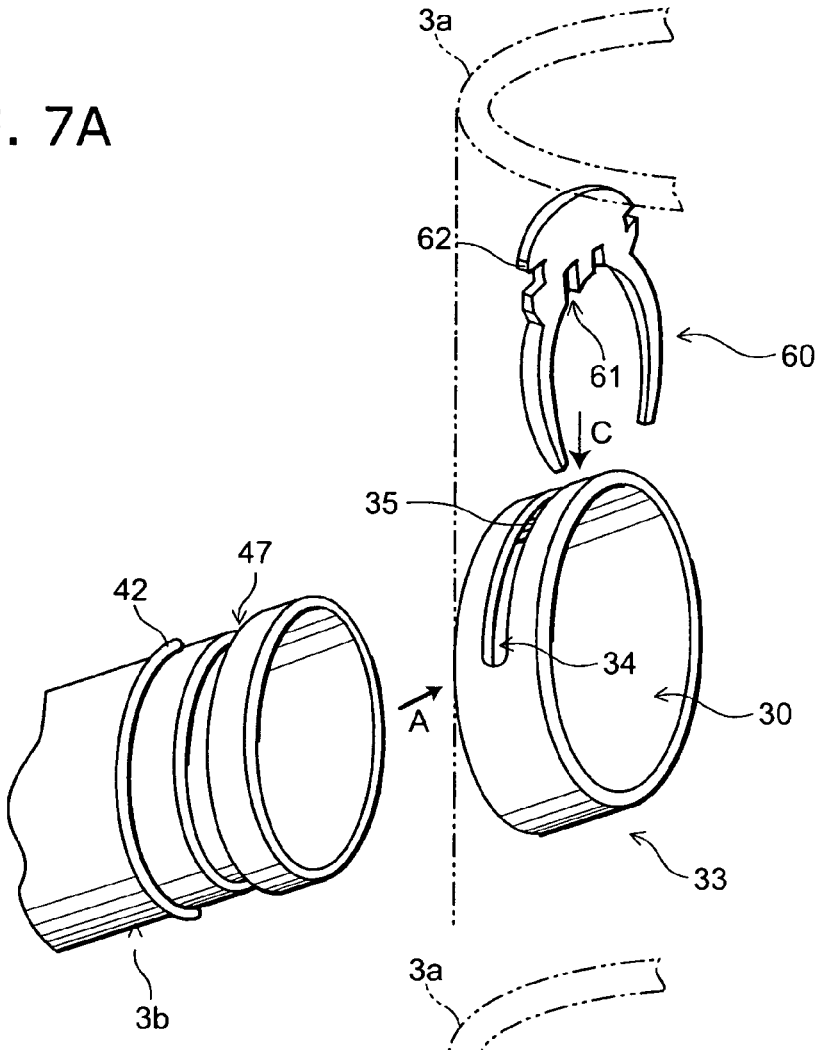
FIGS. 7A and 7B are perspective views of the coupling structure of this example as viewed obliquely.
Figure 7B:
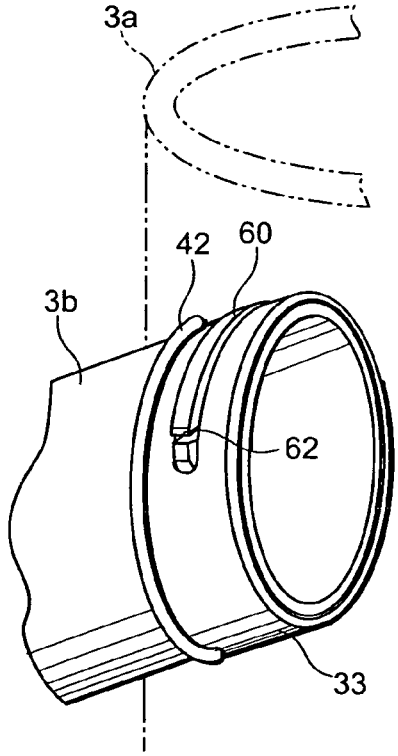

FIG. 7 shows perspective views of the coupling structure of this example as viewed obliquely, where FIG. 7A is a perspective view before coupling the water discharger to the main body, and FIG. 7B is a perspective view after coupling the water discharger to the main body.

For convenience of description, in FIG. 5, the water discharger 3*b* is shown by a side view rather than by a cross-sectional view. The solenoid valve 8, the constant flow valve 55, the generator 11 and the like disposed inside the main body 3*a* and the water discharger 3*b* are not shown.

The main body 3*a* of this example has a protrusion 33 around the opening 30. In the upper portion of the protrusion 33 is provided an insertion hole 34 through which a C-ring 60 is inserted. The horizontal width d6 of the insertion hole 34 is generally equal to the thickness d5 of the C-ring 60. A strut 35 for preventing the rotation of the C-ring 60 is provided in the insertion hole 34.

The water discharger 3*b* has a fitting groove 47, into which the C-ring 60 is fitted, and an O-ring 42 at the joint with the main body 3*a*. As shown in FIG. 5, the fitting groove 47 is disposed nearer to the tip of the water discharger 3*b* than the O-ring 42. The horizontal width d4 of the fitting groove 47 is generally equal to the thickness d5 of the C-ring 60. The horizontal minimum distance d8 between the fitting groove 47 and the O-ring 42 is generally equal to or shorter than the horizontal minimum distance d7 between the outline of the main body 3*a* and the insertion hole 34.

As shown in FIG. 6, the C-ring 60 has a notch 61. The inner diameter d3 of the C-ring 60 is generally equal to the outer diameter of the fitting groove 47 of the water discharger 3*b*. Furthermore, the C-ring 60 has a side face 62 on its lateral side. An operator or user can hold the side face 62 so that the C-ring 60 can be easily inserted into or detached from the insertion hole 34.

When the water discharger 3*b* is inserted into the opening 30 of the main body 3*a* in the direction of the arrow A, the O-ring 42 is brought into contact with the outer periphery of the main body 3*a*. At this time, because the minimum distance d8 is generally equal to or shorter than the minimum distance d7, the fitting groove 47 cannot be entirely seen from the insertion hole 34 as the faucet 3 is viewed from above. Hence, in this state, the C-ring 60 cannot be inserted into the insertion hole 34 and the fitting groove 47.

Then, when the water discharger 3*b* is further inserted in the direction of the arrow A, the O-ring 42 is slightly shrunk, allowing the fitting groove 47 to be entirely seen from the insertion hole 34 as the faucet 3 is viewed from above. At this time, it is possible to insert the C-ring 60 into the insertion hole 34 and the fitting groove 47 by moving the C-ring 60 in the direction of the arrow C. It is noted that the C-ring 60 will not rotate because the strut 35 is slotted into the notch 61 when the C-ring 60 is inserted into the insertion hole 34.

When the C-ring 60 is fitted into the fitting groove 47, the water discharger 3*b* is pushed by a repulsion force from the O-ring 42 in the direction opposite to the arrow A, but does not come off the opening 30 because the C-ring 60 is fitted into the fitting groove 47, and because the thickness d5 of the C-ring is generally equal to the horizontal width d4 of the fitting groove 47. That is, the O-ring 42 is generally pressed into the opening 30, and the water discharger 3*b* is locked into the main body 3*a* with the C-ring 60. Thus the water discharger 3*b* is fixed (coupled) to the main body 3*a*.

Here, the inner diameter of the opening 30 of the main body 3*a* is generally equal to the outer diameter of the water discharger 3*b*, and the O-ring 42 is generally pressed into the opening 30. Hence the water discharger 3*b* is liquid-tightly coupled to the main body 3*a*. On the other hand, it is possible to detach the water discharger 3*b* from the main body 3*a* by holding the side face 62 of the C-ring 60 and pulling it out upward while moving the water discharger 3*b* in the direction of the arrow A.

Figure 8A:
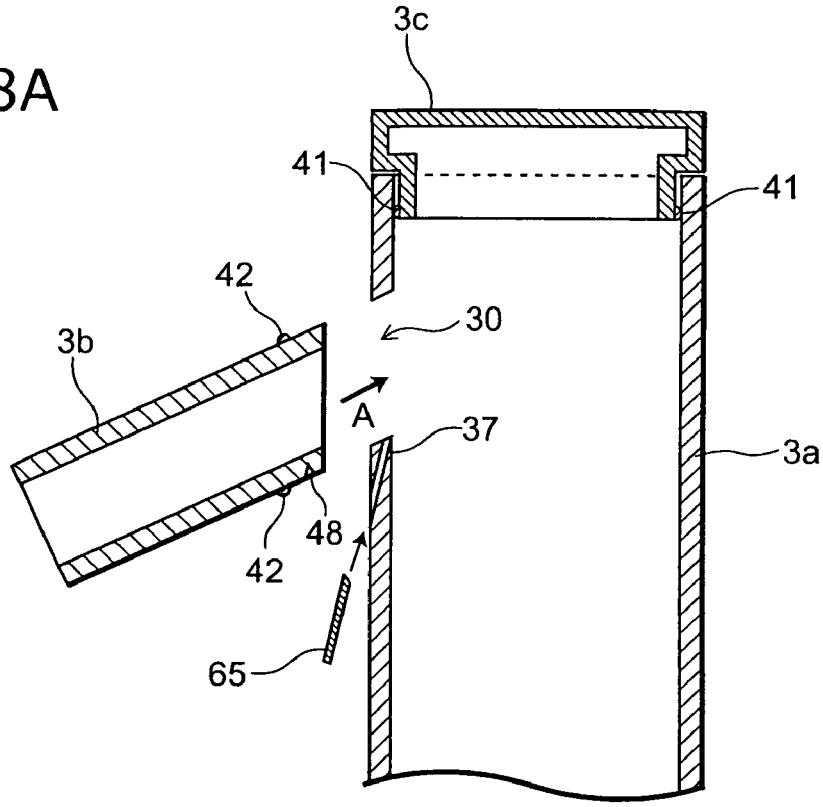
FIGS. 8A and 8B are cross-sectional schematic views illustrating still another example of the coupling structure of the main body and the water discharger.
Figure 8B:
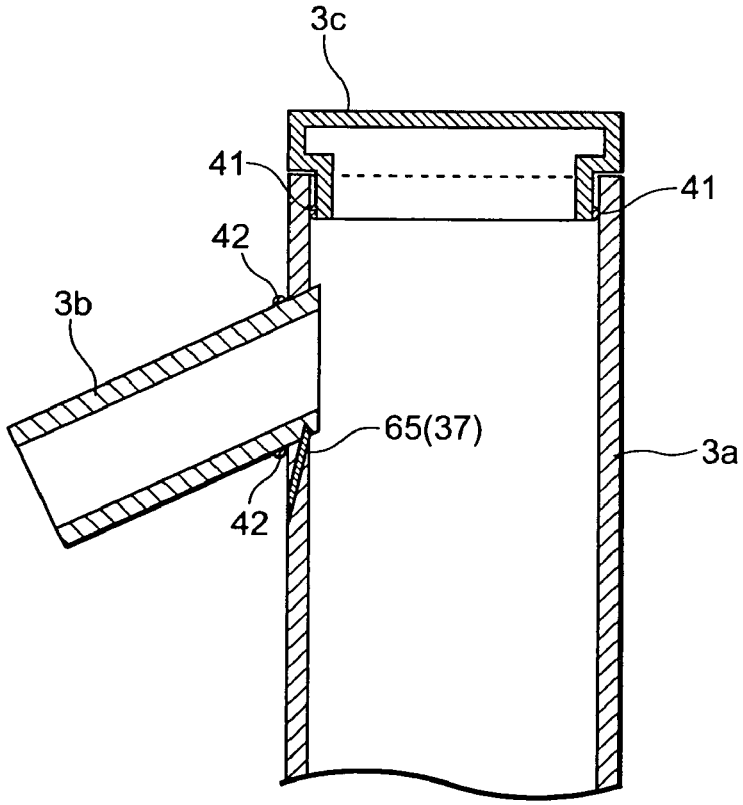

FIG. 8 shows cross-sectional schematic views illustrating still another example of the coupling structure of the main body and the water discharger, where FIG. 8A is a cross-sectional schematic view before coupling the water discharger to the main body, and FIG. 8B is a cross-sectional schematic view after coupling the water discharger to the main body.

For convenience of description, the solenoid valve 8, the constant flow valve 55, the generator 11 and the like disposed inside the main body 3*a* and the water discharger 3*b* are not shown.

The main body 3*a* of this example has a screw hole 37 passing obliquely from below the opening 30 to the outside of the main body 3*a*. On the other hand, the water discharger 3*b* has an O-ring 42 and a notch 48. The notch 48 is provided at the lower portion of the water discharger 3*b*.

When the water discharger 3*b* is inserted into the opening 30 of the main body 3*a* in the direction of the arrow A, the O-ring 42 is brought into contact with the outer periphery of the main body 3*a*. Then, like the above examples, when the water discharger 3*b* is further inserted in the direction of the arrow A with the O-ring 42 generally pressed into the opening 30, the screw hole 37 is made generally collinear with the notch 48. At this time, it is possible to fix the water discharger 3*b* to the main body 3*a* by screwing a set screw 65 into the screw hole 37 toward the notch 48 so that the set screw 65 presses the water discharger 3*b*.

Here, like the above examples, the inner diameter of the opening 30 of the main body 3*a* is generally equal to the outer diameter of the water discharger 3*b*, and the O-ring 42 is generally pressed into the opening 30. Hence the water discharger 3*b* is liquid-tightly coupled to the main body 3*a*. On the other hand, it is possible to detach the water discharger 3*b* from the main body 3*a* by undoing the set screw 65 and moving the water discharger 3*b* in the direction opposite to the arrow A.

This example has been described with reference to the case of fixing the water discharger 3*b* to the main body 3*a* at only one position, but this is not limitative. For example, it is also possible to provide another screw hole 37 above the opening 30, and another notch 48 at the upper portion of the water discharger 3*b*, so that the water discharger 3*b* can be further fixed with a set screw 65 above the opening 30. Furthermore, the water discharger 3*b* may be fixed to the main body 3*a* at three or more positions.

Next, examples of a rotation restriction means used in coupling the water discharger 3*b* to the main body 3*a* are described with reference to the drawings.

In this embodiment, as described above, the first electric components placed inside the main body 3*a* are electrically connected by wiring to the second electric components placed inside the water discharger 3*b*. Hence a coupling configuration where the water discharger 3*b* itself is rotated, for example, screwed, results in twisting the wiring, causing concern about disconnection and damage to the wiring. Therefore it is preferable to provide a rotation restriction means in the main body 3*a* and the water discharger 3*b* so that the water discharger 3*b* is not rotated over a certain angle with respect to the main body 3*a*.

Figure 9A:
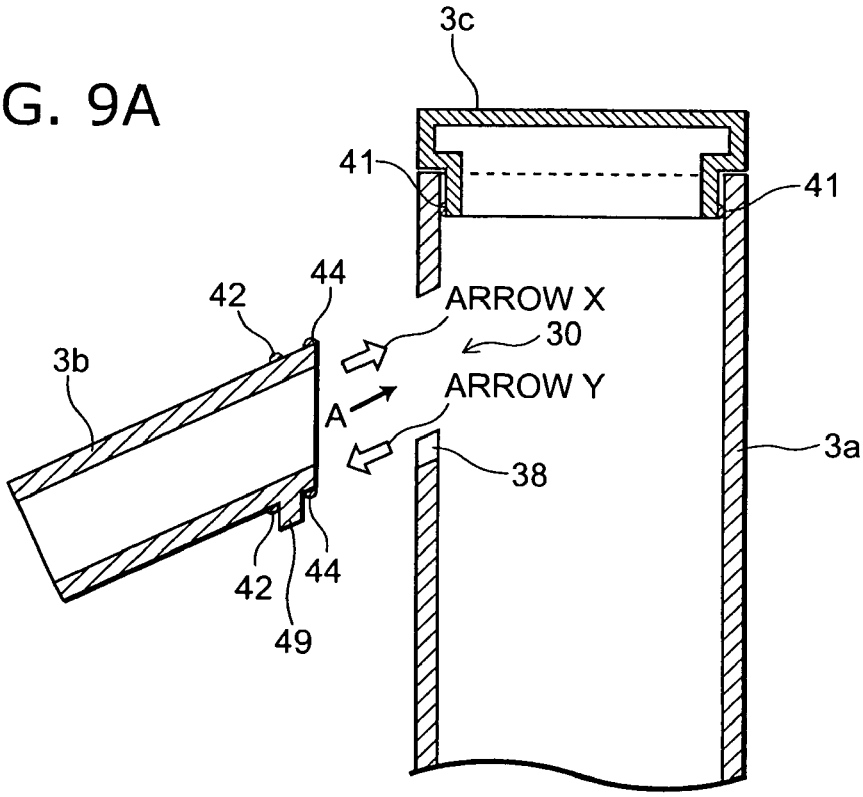
FIGS. 9A and 9B are schematic views illustrating an example of the rotation restriction means of the main body and the water discharger.
Figure 9B:
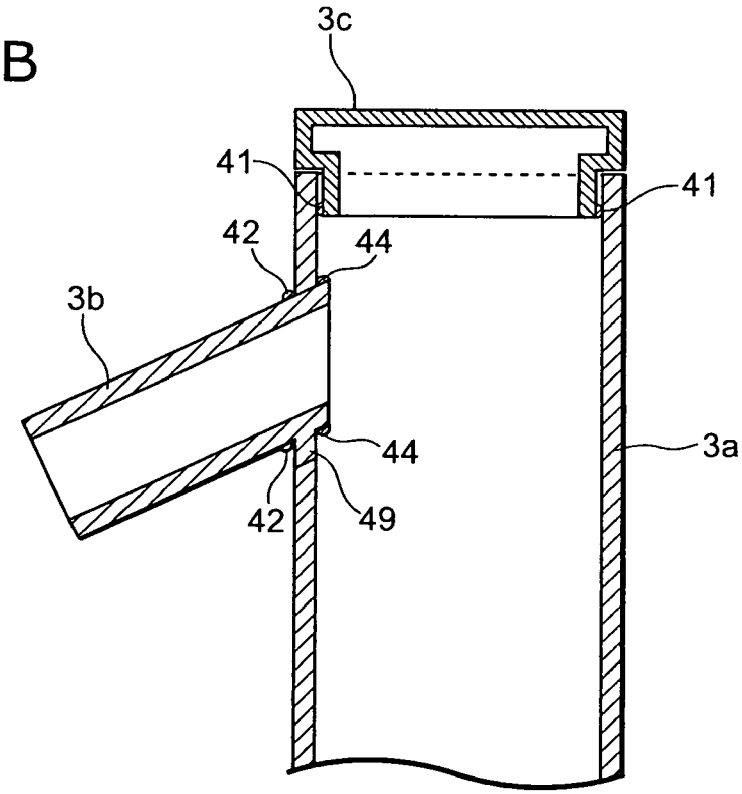

FIG. 9 shows schematic views illustrating an example of the rotation restriction means of the main body and the water discharger, where FIG. 9A is a cross-sectional schematic view before coupling the water discharger to the main body, and FIG. 9B is a cross-sectional schematic view after coupling the water discharger to the main body.

Figure 10A:
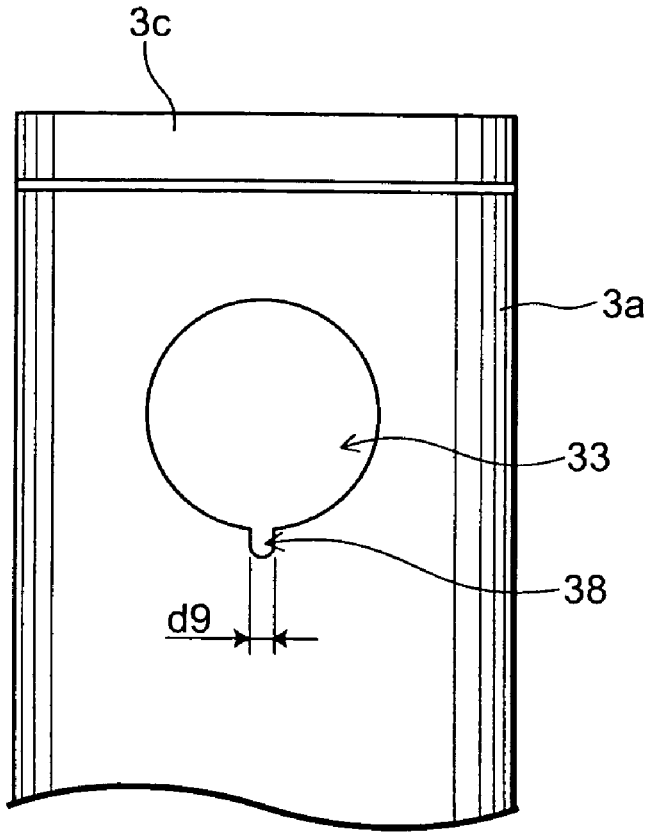
FIGS. 10A and 10B are front views of this example.
Figure 10B:
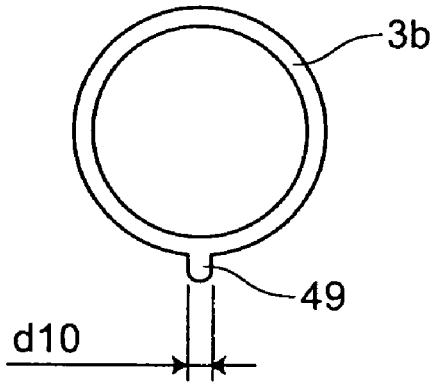

FIG. 10 shows front views of this example, where FIG. 10A is a schematic view of the opening of the main body as viewed in the direction of the arrow X, and FIG. 10B is a schematic view of the joint of the water discharger as viewed in the direction of the arrow Y.

For convenience of description, the solenoid valve 8, the constant flow valve 55, the generator 11 and the like disposed inside the main body 3*a* and the water discharger 3*b* are not shown.

The opening 30 of the main body 3*a* of this example has a notch 38. The notch 38 is provided in the lower portion of the opening 30 and passes through the main body 3*a* from outside to inside. On the other hand, a protrusion 49 is provided in the lower portion of the water discharger 3*b*. The horizontal width d10 of the protrusion 49 is generally equal to or smaller than the horizontal width d9 of the notch 38. The rest of the structure is the same as that of the example faucet 3 shown in FIG. 3. The protrusion 49 is provided between the O-ring 42 and the flexible protrusion 44.

When the water discharger 3*b* is inserted into the opening 30 of the main body 3*a* in the direction of the arrow A, the notch 38 of the opening 30 needs to be aligned with the protrusion 49 of the water discharger 3*b*. If the notch 38 is not aligned with the protrusion 49, the notch 38 and the protrusion 49 interfere with each other, and hence the water discharger 3*b* cannot be inserted into the opening 30.

On the other hand, when the water discharger 3*b* is inserted into the opening 30 of the main body 3*a* with the notch 38 being aligned with the protrusion 49, the water discharger 3*b* cannot be rotated relative to the main body 3*a*. This is because, as described above, the notch 38 interferes with the protrusion 49. Thus the rotation in coupling the water discharger 3*b* to the main body 3*a* can be restricted. The rest of the fixing (coupling) method is the same as that of the example shown in FIG. 3. This example has been described with reference to the case where the notch 38 and the protrusion 49 are provided in the example shown in FIG. 3, but this is not limitative. The notch 38 and the protrusion 49 may be provided in the examples shown in FIGS. 4, 5, and 8.

Figure 11:
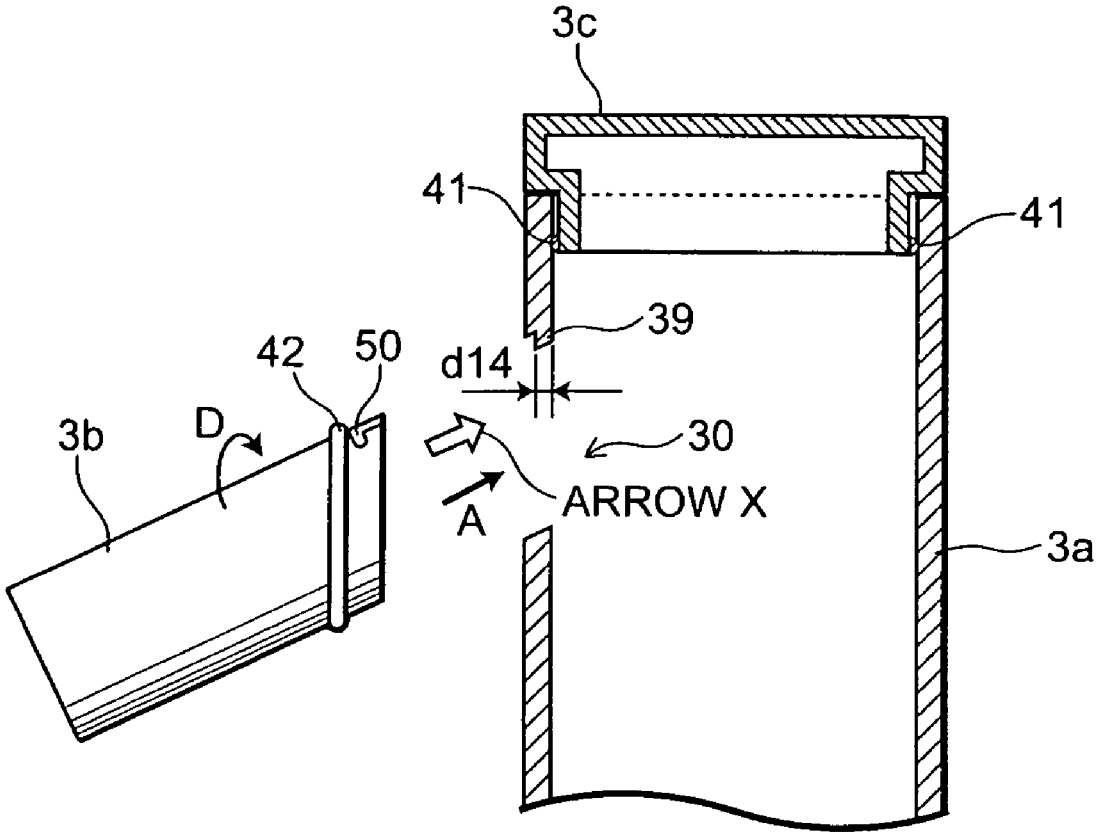
FIG. 11 is a schematic view illustrating another example of the rotation restriction means of the main body and the water discharger.

FIG. 11 shows a schematic view illustrating another example of the rotation restriction means of the main body and the water discharger.

Figure 12:
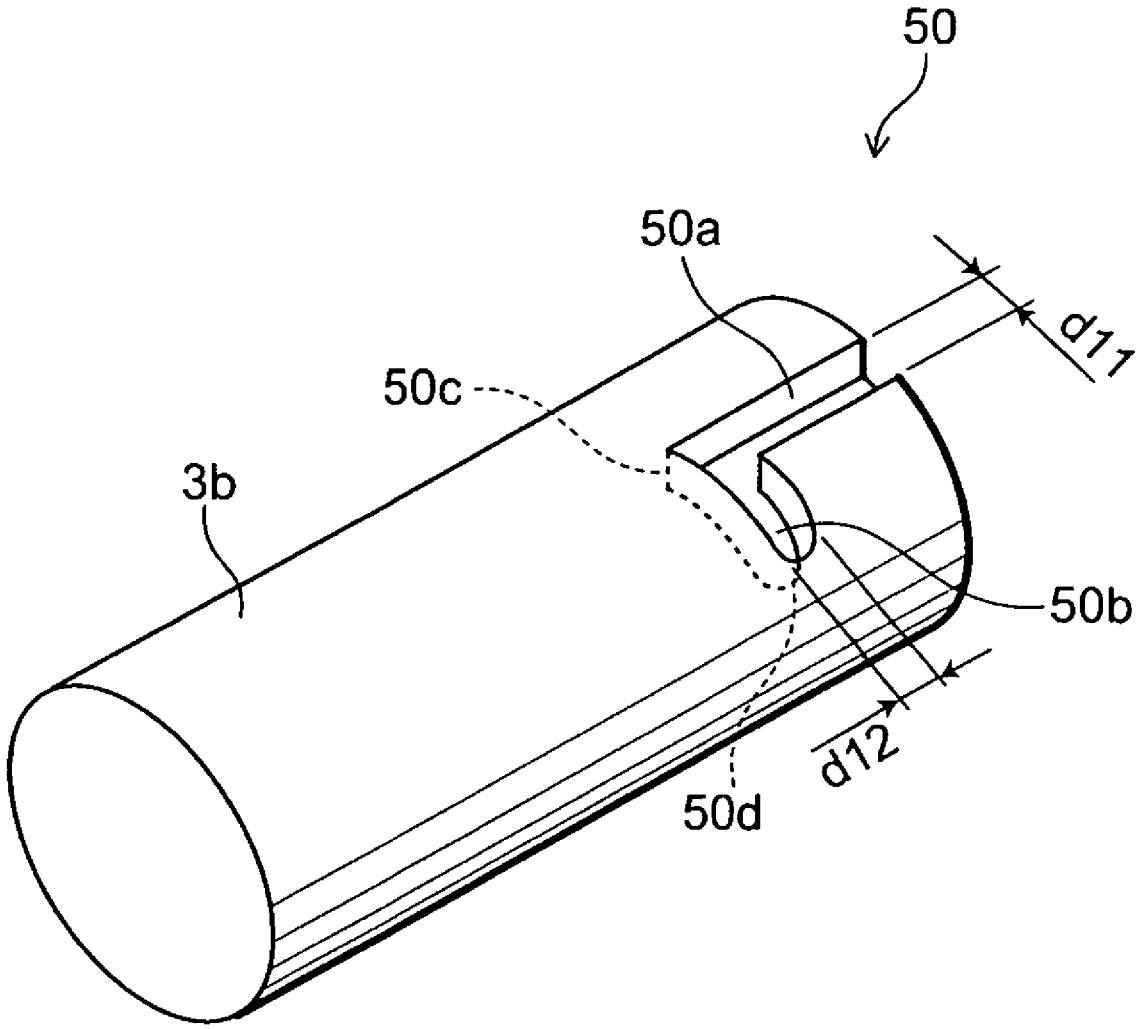
FIG. 12 is a perspective view of the water discharger of this example as viewed obliquely.

FIG. 12 is a perspective view of the water discharger of this example as viewed obliquely.

Figure 13:
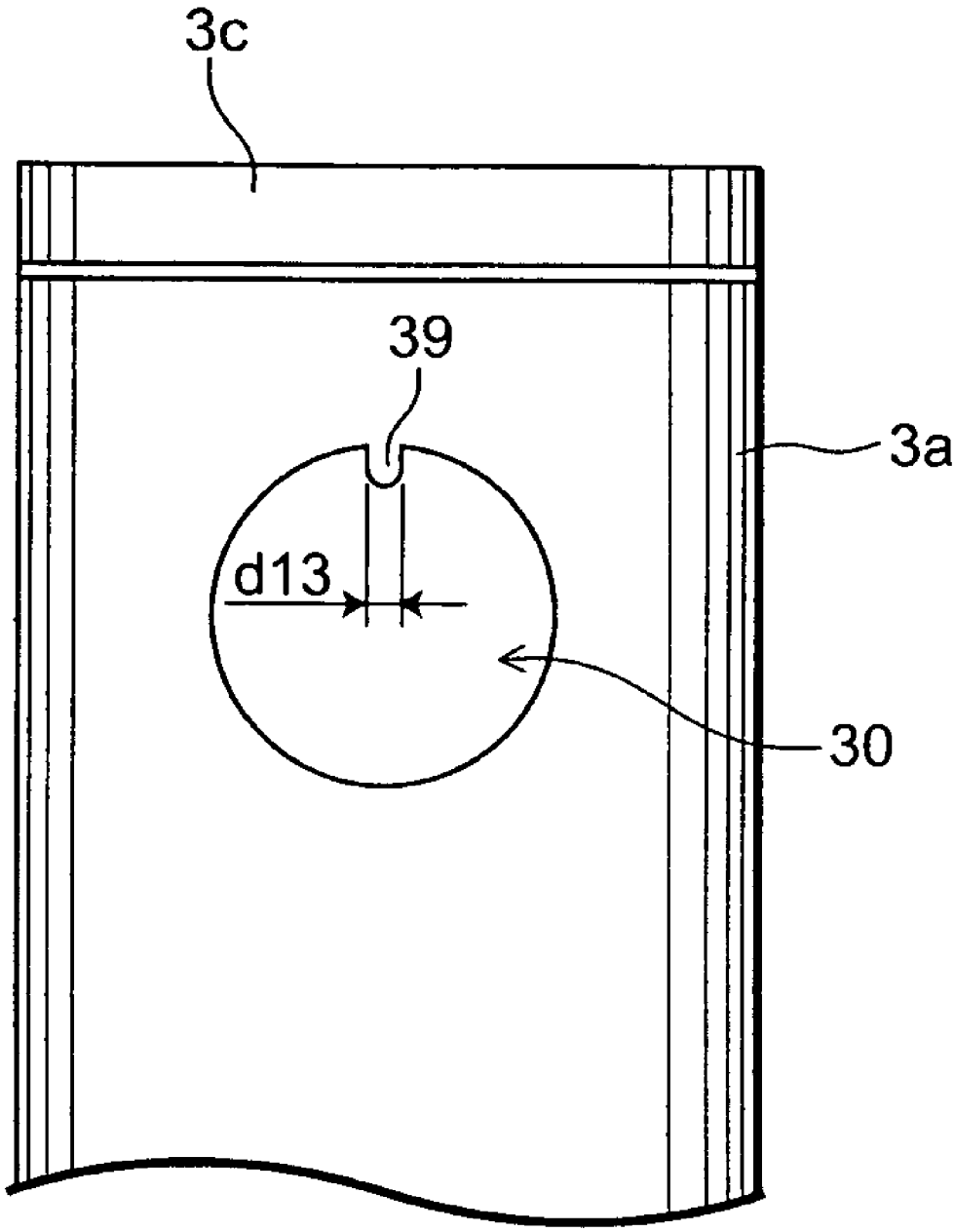
FIG. 13 is a schematic view of the opening of the main body of this example as viewed in the direction of the arrow X.

FIG. 13 is a schematic view of the opening of the main body of this example as viewed in the direction of the arrow X.

For convenience of description, in FIG. 11, the water discharger is shown by a side view rather than by a cross-sectional view. The solenoid valve 8, the constant flow valve 55, the generator 11 and the like disposed inside the main body 3*a* and the water discharger 3*b* are not shown.

The opening 30 of the main body 3*a* of this example has a protrusion 39. As shown in FIG. 13, the protrusion 39 is provided in the upper portion of the opening 30. On the other hand, a rotation restriction groove 50 is provided in the outer periphery of the water discharger 3*b*. The rotation restriction groove 50 includes a longitudinal groove 50*a* extending in the longitudinal direction of the water discharger 3*b* and a peripheral groove 50*b* extending in the peripheral direction of the water discharger 3*b*. The horizontal width d13 of the protrusion 39 is generally equal to or smaller than the horizontal width d11 of the longitudinal groove 50*a*. The thickness d14 of the protrusion 39 is generally equal to or smaller than the horizontal width d12 of the peripheral groove 50*b*.

When the water discharger 3*b* is inserted into the opening 30 of the main body 3*a* in the direction of the arrow A, the protrusion 39 of the opening 30 needs to be aligned with the longitudinal groove 50*a* of the water discharger 3*b*. If the protrusion 39 is not aligned with the longitudinal groove 50*a*, the protrusion 39 and the longitudinal groove 50*a* interfere with each other, and hence the water discharger 3*b* cannot be inserted into the opening 30.

On the other hand, when the water discharger 3*b* is inserted into the opening 30 of the main body 3*a* with the protrusion 39 being aligned with the longitudinal groove 50*a*, the water discharger 3*b* cannot be rotated relative to the main body 3*a* if the protrusion 39 is located in the longitudinal groove 50*a*. This is because, as described above, the protrusion 39 interferes with the longitudinal groove 50*a*.

Then, like the above examples, when the water discharger 3*b* is further inserted in the direction of the arrow A with the O-ring 42 generally pressed into the opening 30, the protrusion 39 is brought into contact with the end 50*c* of the longitudinal groove 50*a*. At this time, if the water discharger 3*b* is rotated in the direction of the arrow D, the protrusion 39 apparently moves inside the peripheral groove 50*b*. Hence, if the protrusion 39 is located in the peripheral groove 50*b*, the water discharger 3*b* can be rotated relative to the main body 3*a*. When the water discharger 3*b* is further rotated in the direction of the arrow D, the protrusion 39 is brought into contact with the end 50*d* of the peripheral groove 50*b*. Here the rotation of the water discharger 3*b* relative to the main body 3*a* is restricted. That is, the water discharger 3*b* can be rotated only within a certain angle relative to the main body 3*a*. Here the certain angle refers to an angle of 360 degrees or less, and preferably an angle of 180 degrees or less.

On the other hand, when the water discharger 3*b* is detached from the main body 3*a*, the water discharger 3*b* needs to be rotated in the direction opposite to the arrow D. That is, because of the peripheral groove 50*b*, it is impossible to detach the water discharger 3*b* from the main body 3*a* simply by moving the water discharger 3*b* in the direction opposite to the arrow A. Hence this example allows the water discharger 3*b* to be coupled to the main body 3*a* more reliably.

It is noted that, by varying the peripheral length of the peripheral groove 50*b*, the above "certain angle" can be varied accordingly. Also in this example, like the above examples, the inner diameter of the opening 30 of the main body 3*a* is generally equal to the outer diameter of the water discharger 3*b*, and the O-ring 42 is generally pressed into the opening 30. Hence the water discharger 3*b* is liquid-tightly coupled to the main body 3*a*.

This example has been described with reference to the case of rotating the water discharger 3*b* in the direction of the arrow D for coupling it to the main body 3*a*, but the structure is not limited thereto. The peripheral groove 50*b* may be provided on the opposite side with respect to the longitudinal groove 50*a*, and the water discharger 3*b* can be coupled to the main body 3*a* by rotation in the direction opposite to the arrow D.

Next, a variation of this embodiment is described with reference to the drawings.

Figure 14:
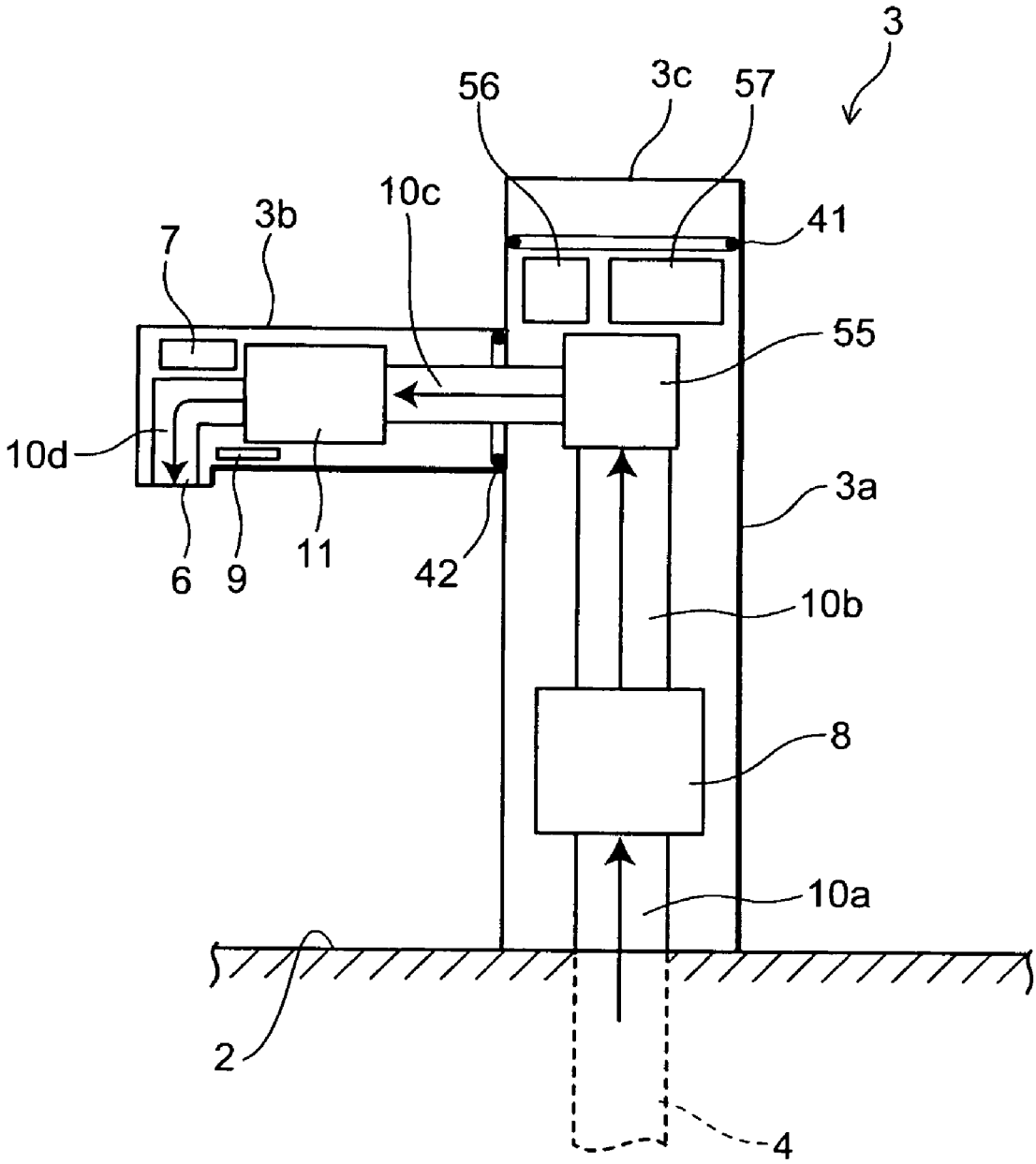
FIG. 14 is a schematic view showing the internal configuration of a faucet according to a variation of this embodiment.

FIG. 14 is a schematic view showing the internal configuration of a faucet according to the variation of this embodiment.

In this variation, the water discharger 3*b* is coupled to the main body 3*a* not obliquely, but generally perpendicularly. Furthermore, the water discharge port 6 is formed so as to face downward, and water that has passed through the first and second water supply channels 10*a*-10*d* is discharged generally vertically downward. Accordingly, the second water supply channel 10*d* is not straight, but has a structure bent perpendicularly halfway through its length. The rest of the structure is the same as that of the faucet 3 described with reference to FIGS. 1 and 2.

Also in this variation, the structure shown in FIGS. 3 to 13 can be provided so that the water discharger 3*b* can be detachably and liquid-tightly coupled to the main body 3*a*.

Furthermore, the water discharger 3*b* can be coupled to the main body 3*a* at a rotation angle set to a certain angle or less.

Moreover, because the sensor 7 and the illuminator 9 are provided so as to face downward or obliquely downward, the so-called "mischief" to the sensor 7 and the illuminator 9 can be prevented.

As described above, according to the embodiment of the invention, the water discharger 3*b* can be liquid-tightly coupled to the main body 3*a*. Furthermore, the water discharger 3*b* can be also detached from the main body 3*a*. Moreover, the water discharger 3*b* can be coupled to the main body 3*a* at a rotation angle of 360 degrees or less. Hence disconnection of and damage to the wiring disposed inside the main body 3*a* and the water discharger 3*b* can be prevented, realizing a faucet with high handleability and reliability for electric components placed inside the faucet 3.

The embodiment of the invention has been described. However, the invention is not limited to the foregoing description. The above embodiment can be modified appropriately by those skilled in the art, and such modifications are also encompassed within the scope of the invention as long as they include the features of the invention. For example, the shape, dimension, material, and placement of the elements included in the faucet 3, the main body 3*a*, and the water discharger 3*b*, and how the O-ring 42 is installed, are not limited to those illustrated above, but can be modified appropriately.

The elements included in the above embodiment can be combined with each other as long as technically feasible, and such combinations are also encompassed within the scope of the invention as long as they include the features of the invention.

The invention claimed is:

1. A faucet comprising:

a main body configured to be installed on a washstand; and a water discharger extending radially outward from a side face of the main body, the water discharger having a water discharge port, the main body including:

a first water supply channel placed inside the main body and being communicative with a water supply piping; and a first electric component placed inside the main body, the water discharger including:

a second water supply channel placed inside the water discharger, being communicative with the first water supply channel, and connected to the water discharge port; and a second electric component placed inside the water discharger and being in electrical connection to the first electric component, the connection between the first electric component and the second electric component being made by wiring, and the main body and the water discharger being detachably coupled to each other at the side face of the main body via a liquid-tight coupling.

2. The faucet according to claim 1, wherein the coupling is such that the water discharger is engaged with the main body at a rotation angle of 360 degrees or less.

3. The faucet according to claim 1, wherein the coupling is such that the water discharger is fitted into the main body.

4. The faucet according to claim 1, wherein the coupling is such that the water discharger is locked into the main body.

5. The faucet according to claim 1, wherein the coupling is such that the water discharger is fixed to the main body by pressing a screw therethrough.

6. The faucet according to claim 1, further comprising:

a rotation restriction mechanism for restricting rotation over a certain angle between the main body and the water discharger.

7. The faucet according to claim 1, wherein one of the first electric component and the second electric component is a generator for generating electric power by hydraulic power of water flowing through at least one of the first water supply channel and the second water supply channel, and the other is a controller for receiving output of the generator.

8. The faucet according to claim 7, wherein the second electric component is the generator.

9. The faucet according to claim 1, wherein one of the first electric component and the second electric component is a sensor for sensing a hand stretched out ahead of the water discharge port, and the other is a controller for controlling the sensor.

10. The faucet according to claim 9, wherein the second electric component is the sensor.

11. The faucet according to claim 1, wherein one of the first electric component and the second electric component is an illuminator for illuminating an area ahead of the water discharge port, and the other is a controller for controlling the illuminator.

12. The faucet according to claim 11, wherein the second electric component is the illuminator.

13. A faucet comprising:

a main body configured to be installed on a washstand; and a water discharger extending radially outward from a side face of the main body, the water discharger having a water discharge port, the water discharger being detachably coupled to the main body at the side face of the main body via a liquid-tight coupling, the main body including a first electric component placed therein, the water discharger including a second electric component placed therein and being in electrical connection to the first electric component, and the main body and the water discharger including a water supply channel being communicative with a water supply piping and the water discharge port.

14. The faucet according to claim 13, wherein the coupling is such that the water discharger is engaged with the main body at a rotation angle of 360 degrees or less.

15. The faucet according to claim 13, wherein the coupling is such that the water discharger is fitted into the main body.

16. The faucet according to claim 13, wherein the coupling is such that the water discharger is locked into the main body.

17. The faucet according to claim 13, wherein the coupling is such that the water discharger is fixed to the main body by pressing a screw therethrough.

18. The faucet according to claim 13, further comprising:

rotation restriction means for restricting rotation over a certain angle between the main body and the water discharger.

19. The faucet according to claim 13, wherein one of the first electric component and the second electric component is a generator for generating electric power by hydraulic power of water flowing through the water supply channel, and the other is a controller for receiving output of the generator.

20. The faucet according to claim 13, wherein one of the first electric component and the second electric component is a sensor for sensing a hand stretched out ahead of the water discharge port, and the other is a controller for controlling the sensor.

* * * * *